US005509595A

United States Patent [19]

Ho

[11] Patent Number: 5,509,595

[45] Date of Patent: Apr. 23, 1996

[54] STAPLING MECHANISM

[76] Inventor: Hsi-Chiun Ho, No. 9, Section 1, Guo Guang Road, Da Li City, Taichung, Taiwan

[21] Appl. No.: 410,689

[22] Filed: Mar. 27, 1995

[51] Int. Cl.[6] ..... B25C 5/02

[52] U.S. Cl. ..... 227/119; 227/134

[58] Field of Search ..... 227/119, 120, 227/132, 134

[56] References Cited

U.S. PATENT DOCUMENTS

| | | | |
|---|---|---|---|
| 1,654,170 | 12/1927 | Hubbard | 227/134 |
| 2,223,322 | 11/1940 | Kilbride | 227/134 |
| 2,309,779 | 2/1943 | Maynard | 227/134 |
| 2,312,142 | 2/1943 | Abrams et al. | 227/134 |
| 2,726,393 | 12/1955 | Vogel | 227/134 |
| 4,243,168 | 1/1981 | Balma | 227/119 |

*Primary Examiner*—Scott A. Smith
*Attorney, Agent, or Firm*—Charles E. Baxley

[57] ABSTRACT

A stapling mechanism includes a base, a chute and a cover pivotally coupled together at one end. A guide rail is disposed in the chute for slidably supporting staples and a pusher may push the staples toward the free end of the chute for engaging with a drive plunger. The guide rail includes a recess formed in the upper portion of the free end for allowing engagement of the staples with the bottom surface of the chute so as to suitably guide the staples and so as to prevent the inclination of the staples.

1 Claim, 3 Drawing Sheets

STAPLING MECHANISM

BACKGROUND OF THE INVENTION

1. Field of the Invention

The present invention relates to a stapling mechanism, and more particularly to a stapling mechanism for effectively driving staples.

2. Description of the Prior Art

A typical stapling mechanism is shown in FIGS. 4 and 5 and comprises a base 11, a chute 13 and a cover 17 including one end pivotally coupled together. The chute 13 includes a guide rail 14 provided therein for supporting the staples 10. A pusher 16 is slidably engaged on the guide rail 14, and a spring 15 is engaged on the guide rail 14 for pushing the staples 10 toward the free end of the chute 13 such that the staples 10 may be punched toward the board 12 by the drive plunger 19 in order to conduct stapling operations. A presser 18 is provided for pressing the staples 10 toward the guide rail 14. However, normally, the staples 10 are supported on the guide rail 14 and are spaced from the bottom of the chute 13 for a short distance such that the staples 10 will be slightly inclined relative to the guide rail 14 when only few staples are supported on the guide rail 14. The staples 10 thus may not be suitably driven by the drive plunger 19 such that the drive plunger 19 may be engaged with and stuck in the chute 14.

The present invention has arisen to mitigate and/or obviate the afore-described disadvantages of the conventional stapling mechanisms.

SUMMARY OF THE INVENTION

The primary objective of the present invention is to provide a stapling mechanism which includes a chute for allowing the engagement of the staples with the bottom of the chute so as to suitably guide the staples and so as to prevent the inclination of the staples such that the staples may be suitably punched.

In accordance with one aspect of the invention, there is provided a stapling mechanism comprising a base, a chute and a cover including a first end pivotally coupled together at a pivot shaft, the chute including a bottom surface and including a second end, the cover including a second end arranged close to the second end of the chute, a guide rail provided in the chute for slidably supporting staples thereon, a pusher slidably engaged on the guide rail, means for biasing the pusher to push the staples toward the second end of the chute, a presser for engaging with the staples, means for biasing the presser toward the staples for pressing the staples in place, and drive plunger means provided in the second end of the cover for driving the staples located in the second end of the chute. The improvement comprises that the guide rail includes a first end located close to the pivot shaft and includes a second end having an upper surface for engaging with the staples, the upper surface of the second end of the guide rail includes a recess formed therein for allowing engagement of the staples with the bottom surface of the chute so as to suitably guide the staples and so as to prevent the inclination of the staples.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
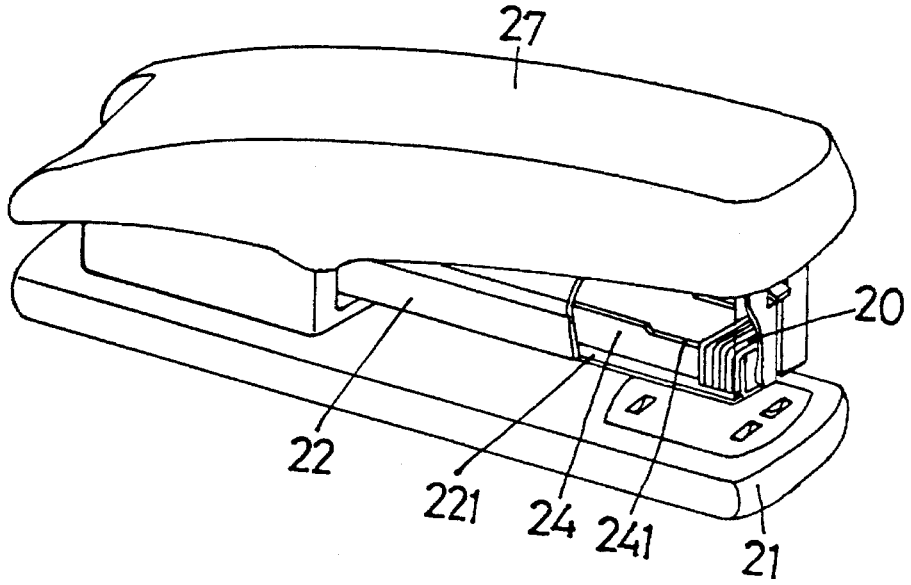
FIG. 1 is a perspective view of a stapling mechanism in accordance with the present invention.
Figure 2:
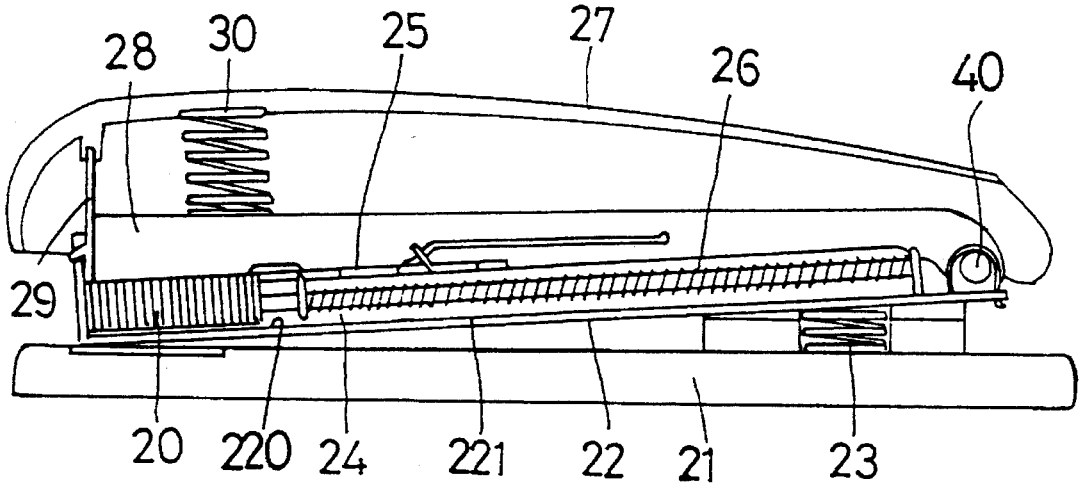
FIGS. 2 and 3 are cross sectional views illustrating the operation of the stapling mechanism.
Figure 3:
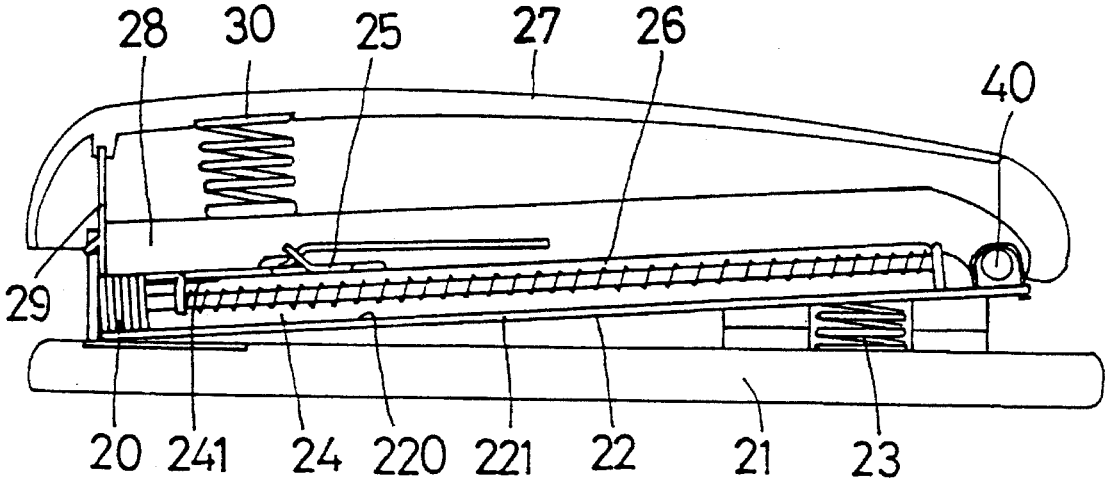
Figure 4:
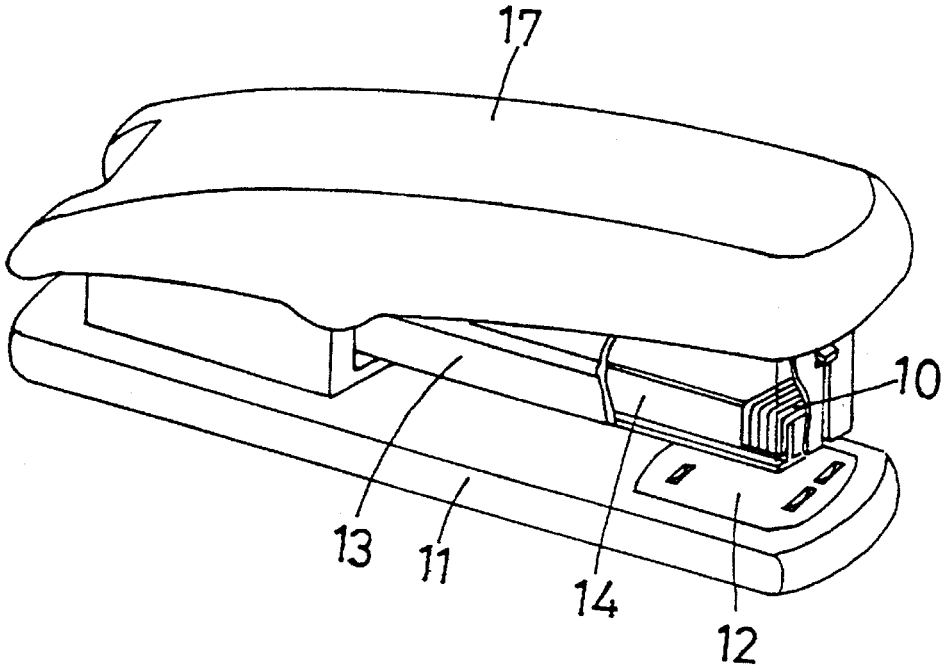
FIG. 4 PRIOR ART
FIG. 4 is a perspective view of a typical stapling mechanism.
Figure 5:
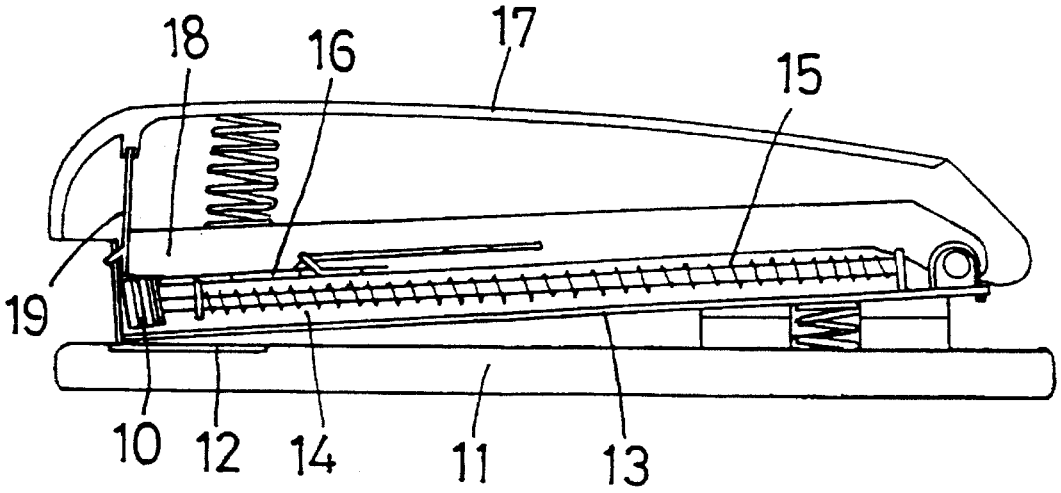
FIG. 5 PRIOR ART
FIG. 5 is a cross sectional views of the typical stapling mechanism.

Referring to the drawings, and initially to FIGS. 1 and 2, a stapling mechanism in accordance with the present invention comprises a base 21, a chute 22 and a cover 27 including one end pivotally coupled together at a pivot shaft 40. The chute 22 includes a guide rail 24 provided therein for slidably supporting the staples 20. A pusher 25 is slidably engaged on the guide rail 24, and a spring 26 is engaged on the guide rail 24 for pushing the staples 20 toward the free end of the chute 22 such that the staples 20 may be punched toward the base 21 by the drive plunger 29 in order to conduct stapling operations. A presser 28 is provided for pressing the staples 20 toward the guide rail 24. A spring 23 is provided for biasing the chute 22 away from the base 21, and another spring 30 is provided for biasing the presser 28 toward the guide rail 24 for pressing the staples 20. The configuration as disclosed above is conventional and will not be described in further details.

The improvement of the present invention includes a recess 241 formed in the upper portion of the free end of the guide rail 24 so as to allow the staples 20 to be depressed downward to engage with and to contact with the bottom surface 220 of the chute 22 when few staples 20 are supported on the guide rail 24; such that the staples 20 may be suitably positioned and may be suitably punched or driven by the drive plunger 29.

Accordingly, the stapling mechanism in accordance with the present invention includes a guide rail 24 having a recess portion 241 formed therein for allowing the engagement of the staples with the bottom of the chute so as to suitably guide the staples and so as to prevent the inclination of the staples such that the staples may be suitably punched.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A stapling mechanism comprising:

a base, a chute and a cover including a first end pivotally coupled together at a pivot shaft, said chute including a bottom surface and including a second end, said cover including a second end arranged close to said second end of said chute, a guide rail provided in said chute for slidably supporting staples thereon, a pusher slidably engaged on said guide rail, means for biasing said pusher to push said staples toward said second end of said chute, a presser for engaging with said staples, means for biasing said presser toward said staples for pressing said staples in place, and drive plunger means provided in said second end of said cover for driving said staples located in said second end of said chute, the improvement comprising:

said guide rail includes a first end located close to said pivot shaft and includes a second end having an upper surface for engaging with said staples, said upper surface of said second end of said guide rail includes a recess formed therein for allowing engagement of said staples with said bottom surface of said chute so as to suitably guide said staples and so as to prevent the inclination of said staples.

* * * * *